US008418377B2

(12) United States Patent
Grunert et al.

(10) Patent No.: US 8,418,377 B2
(45) Date of Patent: Apr. 16, 2013

(54) DRYER WITH HEAT PUMP

(75) Inventors: Klaus Grunert, Berlin (DE); Günter Steffens, Dallgow-Döberitz (DE); Andreas Stolze, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 751 days.

(21) Appl. No.: 12/290,917

(22) Filed: Nov. 5, 2008

(65) Prior Publication Data

US 2009/0113740 A1 May 7, 2009

(30) Foreign Application Priority Data

Nov. 6, 2007 (DE) ..... 10 2007 052 839

(51) Int. Cl.
*F26B 19/00* (2006.01)

(52) U.S. Cl.
USPC ..... 34/86; 34/596; 34/610; 68/20; 8/137; 73/23.2; 165/48.1; 318/400.32

(58) Field of Classification Search ..... 34/80, 86, 34/596, 600, 601, 606, 610, 81, 82, 595; 68/6, 20; 8/137; 73/23.2; 165/48.1; 318/400.32; 705/14
See application file for complete search history.

(56) References Cited

U.S. PATENT DOCUMENTS

| | | | | | |
|---|---|---|---|---|---|
| 2,660,806 | A | * | 12/1953 | Whitesel | 34/77 |
| 2,771,558 | A | * | 11/1956 | Young | 307/35 |
| 2,874,310 | A | * | 2/1959 | Young | 307/34 |
| 2,986,904 | A | * | 6/1961 | Williamson | 62/429 |
| 3,803,847 | A | * | 4/1974 | McAlister | 60/721 |
| 3,931,683 | A | * | 1/1976 | Crites et al. | 34/169 |
| 3,935,899 | A | * | 2/1976 | Jolly | 165/240 |
| 4,205,456 | A | * | 6/1980 | Ayers et al. | 34/515 |
| 4,265,220 | A | * | 5/1981 | McAlister | 126/610 |
| 4,301,862 | A | * | 11/1981 | McAlister | 165/165 |
| 4,311,191 | A | * | 1/1982 | VanderVaart | 165/240 |
| 4,311,192 | A | * | 1/1982 | VanderVaart | 165/240 |
| 4,420,034 | A | * | 12/1983 | VanderVaart | 165/240 |
| 4,433,557 | A | * | 2/1984 | McAlister | 62/324.1 |

(Continued)

FOREIGN PATENT DOCUMENTS

| | | | |
|---|---|---|---|
| DE | 30 00 865 | | 7/1981 |
| DE | 42 12 700 | | 10/1993 |
| DE | 4212697 | A1 * | 10/1993 |
| DE | 4212700 | A1 * | 10/1993 |
| DE | 43 06 217 | | 9/1994 |
| DE | 4422191 | A1 * | 1/1995 |

(Continued)

OTHER PUBLICATIONS

National Search Report DE 10 2007 052 839.8.

*Primary Examiner* — Stephen M. Gravini
(74) *Attorney, Agent, or Firm* — James E. Howard; Andre Pallapies

(57) ABSTRACT

A dryer with a drying chamber that includes a process air duct for guiding process air through the drying chamber, a heat pump with a heat sink in the process air duct and through which air can flow in an outlet air direction for cooling down the process air, and a heat source arranged in the process air duct and through which air can flow in an inlet air direction for heating up the process air. The outlet air direction and the inlet air direction are substantially parallel to one another. The heat sink and the heat source are in a plane substantially perpendicular to the outlet air direction and to the inlet air direction alongside one another.

28 Claims, 2 Drawing Sheets

U.S. PATENT DOCUMENTS 4,436,058 A * 3/1984 McAlister ..... 122/19.1
4,441,546 A * 4/1984 VanderVaart ..... 165/231
4,461,345 A * 7/1984 Vandervaart ..... 165/113
4,473,060 A * 9/1984 Bangerter ..... 126/101
4,541,479 A * 9/1985 Bergeron, Jr. ..... 165/45
4,602,676 A * 7/1986 Bergeron, Jr. ..... 165/45
4,603,489 A * 8/1986 Goldberg ..... 34/77
4,621,438 A * 11/1986 Lanciaux ..... 34/77
4,644,666 A * 2/1987 Eberle et al. ..... 34/515
4,651,805 A * 3/1987 Bergeron, Jr. ..... 165/45
4,780,218 A * 10/1988 Kohler ..... 210/774
4,874,472 A * 10/1989 Kohler ..... 202/169
4,907,738 A * 3/1990 Harris ..... 237/2 B
4,938,845 A * 7/1990 Kohler ..... 202/169
6,550,687 B2 * 4/2003 Lyons et al. ..... 237/55
6,908,039 B2 * 6/2005 Lyons et al. ..... 237/55
7,020,985 B2 * 4/2006 Casey et al. ..... 34/595
7,024,795 B2 * 4/2006 Tadano et al. ..... 34/76
7,191,543 B2 * 3/2007 Yakumaru et al. ..... 34/77
7,191,546 B2 * 3/2007 Maruca ..... 34/201
7,194,823 B2 * 3/2007 Nakamoto et al. ..... 34/526
7,206,670 B2 * 4/2007 Pimputkar et al. ..... 700/291
7,347,009 B2 * 3/2008 Ahn et al. ..... 34/607
7,377,052 B2 * 5/2008 Maruca ..... 34/201
7,409,776 B2 * 8/2008 Ono et al. ..... 34/77
7,469,486 B2 * 12/2008 Tamura et al. ..... 34/77
7,497,030 B2 * 3/2009 Belgard ..... 34/82
7,526,879 B2 * 5/2009 Bae et al. ..... 34/596
7,812,557 B2 * 10/2010 Maekawa ..... 318/400.32
7,866,061 B2 * 1/2011 Tatsumi et al. ..... 34/595
7,908,766 B2 * 3/2011 Ahn et al. ..... 34/595
2001/0042610 A1 * 11/2001 Lyons et al. ..... 165/47
2003/0098358 A1 * 5/2003 Lyons et al. ..... 237/55
2003/0229572 A1 * 12/2003 Raines et al. ..... 705/37
2004/0025532 A1 * 2/2004 Scaringe et al. ..... 62/474
2005/0044744 A1 * 3/2005 Tadano et al. ..... 34/596
2005/0102068 A1 * 5/2005 Pimputkar et al. ..... 700/291
2005/0120577 A1 * 6/2005 Nakamoto et al. ..... 34/74
2005/0198852 A1 * 9/2005 Ono et al. ..... 34/77
2005/0199016 A1 * 9/2005 Tadano et al. ..... 68/18 C
2005/0210698 A1 * 9/2005 Casey et al. ..... 34/134
2005/0217133 A1 * 10/2005 Yakumaru et al. ..... 34/134
2005/0246920 A1 * 11/2005 Yabuuchi et al. ..... 34/515
2005/0278972 A1 * 12/2005 Maruca ..... 34/201
2006/0117593 A1 * 6/2006 Ahn et al. ..... 34/513
2006/0179681 A1 * 8/2006 Tamura et al. ..... 34/475
2006/0266043 A1 * 11/2006 Jerome ..... 60/651
2007/0062513 A1 * 3/2007 Gagas ..... 126/299 D
2007/0101602 A1 * 5/2007 Bae et al. ..... 34/77
2007/0107255 A1 * 5/2007 Tamura et al. ..... 34/475
2007/0108181 A1 * 5/2007 Gassmann et al. ..... 219/400
2007/0113419 A1 * 5/2007 Belgard ..... 34/82
2007/0144032 A1 * 6/2007 Maruca ..... 34/469
2007/0163277 A1 * 7/2007 Tamura ..... 62/160
2008/0034607 A1 * 2/2008 Ahn et al. ..... 34/130
2008/0034608 A1 * 2/2008 Ahn et al. ..... 34/134
2008/0147465 A1 * 6/2008 Raines et al. ..... 705/7
2008/0216341 A1 * 9/2008 Mukaiyama et al. ..... 34/124
2008/0235977 A1 * 10/2008 Kuwabara ..... 34/77
2008/0289209 A1 * 11/2008 Han et al. ..... 34/74
2008/0289212 A1 * 11/2008 Moon et al. ..... 34/267
2008/0297099 A1 * 12/2008 Maekawa ..... 318/799
2009/0000040 A1 * 1/2009 Ikemizu ..... 8/158
2009/0056385 A1 * 3/2009 Maekawa ..... 68/12.16
2009/0064531 A1 * 3/2009 Moon et al. ..... 34/491
2009/0065536 A1 * 3/2009 Moon et al. ..... 223/70
2009/0071033 A1 * 3/2009 Ahn et al. ..... 34/595
2009/0094852 A1 * 4/2009 Tatsumi et al. ..... 34/132
2009/0095032 A1 * 4/2009 Lee ..... 68/5
2009/0100702 A1 * 4/2009 Fair ..... 34/487
2009/0133284 A1 * 5/2009 Belgard ..... 34/480
2009/0139107 A1 * 6/2009 Grunert et al. ..... 34/86
2009/0151188 A1 * 6/2009 Moon et al. ..... 34/218
2009/0151191 A1 * 6/2009 Grunert ..... 34/480
2009/0151193 A1 * 6/2009 Moon et al. ..... 34/621
2009/0165328 A1 * 7/2009 Grunert et al. ..... 34/443
2009/0194601 A1 * 8/2009 Flohr ..... 236/51
2009/0211309 A1 * 8/2009 Kawabata et al. ..... 68/20
2009/0241606 A1 * 10/2009 Yoo et al. ..... 68/5
2009/0248206 A1 * 10/2009 Yoo et al. ..... 700/275
2009/0260250 A1 * 10/2009 Moon et al. ..... 34/202
2010/0005678 A1 * 1/2010 Steffens ..... 34/80
2010/0011608 A1 * 1/2010 Grunert et al. ..... 34/85
2010/0011615 A1 * 1/2010 Steiner ..... 34/493
2010/0018072 A1 * 1/2010 Kim et al. ..... 34/86
2010/0037480 A1 * 2/2010 Steffens ..... 34/468
2010/0058608 A1 * 3/2010 Moon et al. ..... 34/282
2010/0107703 A1 * 5/2010 Hisano et al. ..... 68/20
2010/0132130 A1 * 6/2010 Moon et al. ..... 8/137
2010/0132209 A1 * 6/2010 Park et al. ..... 34/201
2010/0139366 A1 * 6/2010 Krausch ..... 73/23.34
2010/0146811 A1 * 6/2010 Steffens ..... 34/480
2010/0154248 A1 * 6/2010 Stolze ..... 34/493
2010/0170101 A1 * 7/2010 Taniguchi et al. ..... 34/132
2010/0192397 A1 * 8/2010 Kim et al. ..... 34/73
2010/0199512 A1 * 8/2010 Tomochika et al. ..... 34/73
2010/0257748 A1 * 10/2010 Steffens et al. ..... 34/72
2010/0263226 A1 * 10/2010 Balerdi Azpilicueta et al. ..... 34/475
2010/0293804 A1 * 11/2010 Nawrot et al. ..... 34/86
2010/0300645 A1 * 12/2010 Glover ..... 165/48.1
2010/0307018 A1 * 12/2010 Driussi ..... 34/79
2011/0000097 A1 * 1/2011 Grunert et al. ..... 34/73
2011/0000099 A1 * 1/2011 Steffens ..... 34/493
2011/0000100 A1 * 1/2011 Malcher et al. ..... 34/499
2011/0005096 A1 * 1/2011 Stolze ..... 34/468
2011/0005097 A1 * 1/2011 Moon et al. ..... 34/493
2011/0005276 A1 * 1/2011 Moon et al. ..... 68/6
2011/0005279 A1 * 1/2011 Yoo et al. ..... 68/5
2011/0030147 A1 * 2/2011 Yoo et al. ..... 8/137
2011/0041353 A1 * 2/2011 Bache et al. ..... 34/218
2011/0056523 A1 * 3/2011 Grunert et al. ..... 134/34
2011/0061014 A1 * 3/2011 Frader-Thompson et al. ..... 715/771
2011/0063126 A1 * 3/2011 Kennedy et al. ..... 340/870.02
2011/0099918 A1 * 5/2011 Buchmann ..... 52/79.1

FOREIGN PATENT DOCUMENTS

DE 197 38 735 3/1999
EP 0 467 188 1/1992
EP 0 999 302 5/2000
EP 1 884 586 2/2008
EP 2199452 A1 * 6/2010
JP 2000070596 A * 3/2000
JP 2001062194 A * 3/2001
JP 2004-89415 3/2004
JP 2005027768 A * 2/2005
JP 2005040316 A * 2/2005
JP 2005304985 A * 11/2005
JP 2005304987 A * 11/2005
JP 2006087672 A * 4/2006
JP 2007000386 A * 1/2007
JP 2007068871 A * 3/2007
JP 2007082587 A * 4/2007
JP 2007082588 A * 4/2007
JP 2007082830 A * 4/2007
JP 2007082834 A * 4/2007
JP 2007082864 A * 4/2007
JP 2007105209 A * 4/2007
JP 2007135898 A * 6/2007
JP 2007135958 A * 6/2007
JP 2007135960 A * 6/2007
JP 2007136055 A * 6/2007
JP 2007143631 A * 6/2007
JP 2007301130 A * 11/2007
JP 2007319458 A * 12/2007
JP 2008264164 A * 11/2008
JP 2009072372 A * 4/2009
JP 2009106566 A * 5/2009
JP 2009273488 A * 11/2009
WO WO 2007074040 A1 * 7/2007
WO WO 2010003936 A1 * 1/2010

* cited by examiner

DRYER WITH HEAT PUMP

BACKGROUND OF THE INVENTION

The invention relates to a dryer with a drying chamber for items to be dried, which features a process air guide for guiding process air through the drying chamber as well as a heat pump with a heat sink which is arranged in the process air duct and through which the process air can flow in an outlet air direction and a heat source arranged in the process air guide and through which the process air can flow in an inlet air direction for heating the process air. Such a vented dryer is based on the abstract to be found in the database "Patent Abstracts of Japan" relating to publication JP 2004 089415 A.

Dryers for items of washing and similar objects are usually embodied as vented dryers or condenser dryers. With vented dryers a stream of air is sucked in from the surroundings of the dryer, heated up, passed over the objects to be dried and subsequently discharged from the dryer as "vented air." This vented air contains the moisture to be extracted from the objects to be dried and can therefore not simply be expelled into a building since the moisture would condense therein; instead the air must be vented from the building using an appropriate vent hose. This is a constructional disadvantage of the vented air dryer, which in other respects is very simple in its construction and can be marketed at low cost. A condenser dryer, the functioning of which is based on removing the condensation from the objects to be dried by means of process air guided in a closed circuit, does not need any vent hose for removing the moisture-laden process air since the moisture condensed within it is stored as liquid and disposed of after the drying has ended and it can therefore be used in an internal bathroom or an internal kitchen of a larger living space. All this applies both to tumble dryers designed specifically for drying washing and to so-called washer-dryers which can both wash and dry washing. Any subsequent reference to a dryer thus applies both to an appliance for drying and also to an appliance intended for washing and drying.

In a vented air dryer, after the moisture-laden air passes through a laundry drum, it is vented from the dryer without any heat recovery generally being undertaken. A vented air dryer with heat recovery is known from the abstract cited above and document DE 30 00 865 A1 respectively. With a vented air dryer with heat recovery, surrounding air (of e.g. 20° C. and 60% relative humidity; so-called inlet air) flows into an air-air heat exchanger or a heat pump and is heated up there as the hot air coming from the drying chamber cools down. In the heat exchanger (e.g. air-air heat exchanger) the moist process air is cooled down, so that water contained in the moist process air condenses. Depending on the cooling power or the exchange of heat, condensation occurs which is collected or pumped into a container (condensation tray) for later disposal.

Both in a conventional vented air dryer and also in a conventional condensing dryer the heat supplied to the process air is largely lost. In a vented air dryer the heat is discharged with the process air laden with moisture from the objects to be dried, in a condenser dryer the heat passes via a heat exchanger into a cooling medium, usually cool air from the surroundings of the dryer, and is thus likewise lost.

DE 40 23 000 C2 describes a tumble dryer with a heat pump in which an inlet air guide is arranged in the process air duct between the condenser and the evaporator which can be closed off with a controllable closure device.

DE 197 38 735 C2 describes a condensing dryer with a closed drying air circuit which is equipped with a heat pump. The heat pump is embodied as a device operating on the absorber principle of which the absorber forms a third heat exchanger, through the primary circuit of which a coolant flows and via the secondary circuit of which the drying air flowing out of the second heat exchanger is fed back into the secondary circuit of the first heat exchanger.

In addition DE 43 06 217 B4 describes a program-controlled tumble dryer, in which the process air is directed by means of a fan in a closed process air duct, in which closure devices arranged in a specific manner are located. Depending on the operating state (heating-up phase, tumble drying phase, reaching the maximum permitted temperature) the closure devices are actuated in a suitable manner.

With a condenser dryer equipped with a heat pump the cooling down of the heated moisture-laden process air and the condensing out of the moisture contained therein essentially occurs in a subsequent first heat exchanger of the heat pump known as a "heat sink", especially an evaporator, where the transmitted heat is used for vaporization of a coolant circulating in the heat pump. Such coolant, evaporated as a result of the heating up, is fed via a compressor, a second heat exchanger of the heat pump which will be referred to below as the "heat source" and in this case is a condenser for the coolant, where, as a result of the condensation of the gaseous coolant heat is released, which is used in its turn for heating up the process air before it enters the drum. The vaporized coolant passes through a throttle which reduces its pressure and returns to the evaporator, in order to evaporate there while once again accepting heat from the process air.

SUMMARY OF THE INVENTION

A heat pump in this document is to be understood as any unit comprising a heat sink, a heat source and means for transferring heat which was accepted into the heat sink into the heat source, where this is emitted again if necessary at a changed temperature level compared to that of the heat sink. Such units are known which operate with cyclic evaporation and condensing of a coolant which as a rule is fluorinated hydrocarbon; this is a compressor unit as described above. This unit generally operates best within a specific temperature range. Other embodiments of heat pumps are known, for example an embodiment in which a working substance such as water is cyclically adsorbed and desorbed by a suitable substrate, especially a Zeolith.

With all known embodiments however the cleaning of the components of the heat pump, especially the heat sink, is complex. Such components can as a rule not be installed so as to be able to be removed easily for cleaning, as is generally known for the heat exchanger of a conventional condenser dryer; the reason for this is that, with a compressor unit in particular, the circuit of the coolant may not be separated to exclude the possibility of coolant escaping from it or of air getting into it. Accessibility to the components is under some circumstances likewise very restricted, with significant effort having to be made to be able to get to the components for the purposes of maintaining or cleaning them.

An object of the present invention is to create a dryer in which access to components of the heat pump can be improved.

An inventive dryer with a dying chamber for objects to be dried has a process air duct for guiding process air through the drying chamber as well as a heat pump circuit with a heat sink arranged in the process air duct and through which air can flow in the outlet air direction for cooling down the process air and a heat source arranged in the process air duct and through which the process air can flow in the inlet air direction for heating up the process air; in this case the outlet air direction and the inlet air direction are essentially parallel to one another, and the heat sink and the heat source are arranged in a plane essentially at right angles to the inlet air direction and the outlet air direction alongside one another.

This embodiment enables easier access to be guaranteed, and makes cleaning processes or other checks and suchlike possible with less effort. The dryer is especially embodied as a vented air dryer. An arrangement of the said components alongside each other is understood as a positioning in which these components, when viewed in a spatial direction towards the domestic appliance, are arranged with essentially the same orientation of their longitudinal axes next to one another and without overlapping in a spatial direction at right angles to the direction of view, with a longitudinal axis being understood as the direction in which the process air flows through the observed component.

The heat sink and the heat source, when the domestic appliance is viewed from the front, are preferably arranged next to one another. It is precisely this specification which greatly improves access to these two components.

In particular the heat sink and the heat source are arranged next to one another, with a space between them.

In the inventive dryer the heat sink is preferably an evaporator for a coolant circulating in the heat pump, and the heat source is a condenser for the coolant. This means that within the framework of this preferred embodiment the heat pump is a compressor unit.

Preferably, a flap is arranged on a wall of the domestic appliance through which at least the heat sink or the heat source, especially the heat sink and the heat source, are accessible. As well as the specific positioning provided for the two components in relation to each other, this arrangement close to the wall also enables greater accessibility to be guaranteed via the flap. The fact that only a single flap is provided, through the opening of which both components are simultaneously able to be accessed for cleaning and maintenance purposes, enables an especially advantageous design to be created. In particular the at least one flap, especially the single flap, is embodied on a front wall of the domestic appliance.

In particular, a filter is arranged in the direction of flow of the process air in front of the heat source. In particular this filter is arranged to allow it to be released without destroying it, so that it can be removed reversibly and inserted again or can be replaced by another filter. This enables dust and other particles to be filtered out from the air surrounding the dryer before the heat source and the process air effectively cleaned, and thus the full functional capability of the heat pump to be assured.

BRIEF DESCRIPTION OF THE DRAWINGS

Exemplary embodiments of the invention are explained in greater detail below with reference to the schematic drawing. The figures are as follows.

In the figures the same elements or those with the same function have been labeled with the same reference symbols.

DETAILED DESCRIPTION OF EXEMPLARY EMBODIMENTS

Figure 1:
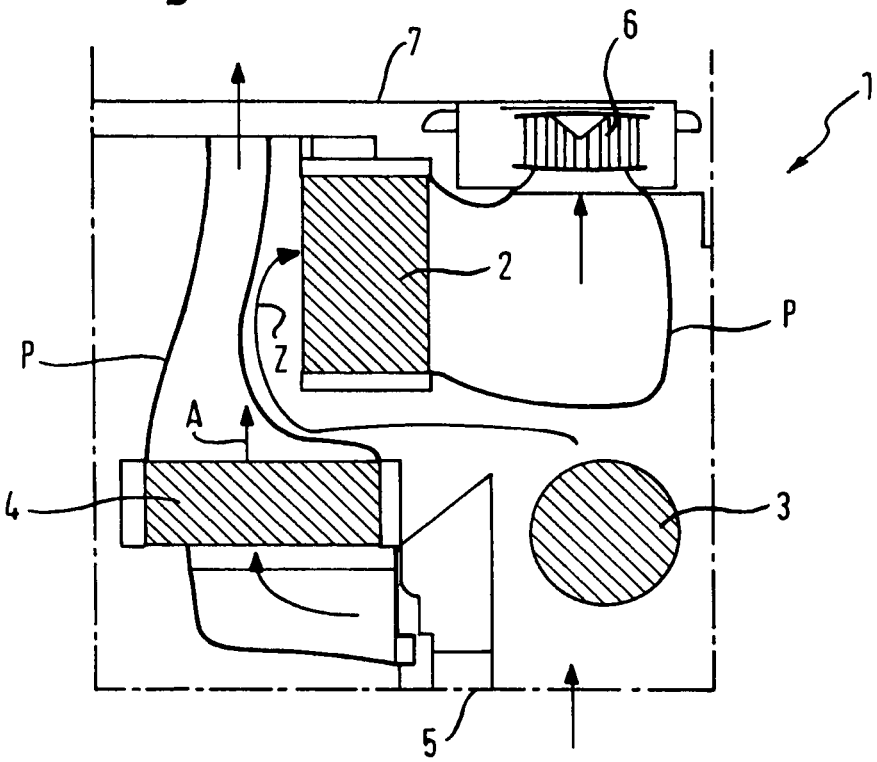
FIG. 1 a schematic overhead view of an exemplary embodiment of a known dryer.

FIG. 1 of the enclosed drawing shows a schematic overhead view of a known dryer 1 with heat pump 3, 4, 5, 10, with the heat pump featuring a condenser 2 as heat source 2, a compressor 3 and an evaporator 4 as heat sink 4. The heat pump 3, 4, 5, 10 is thus a compressor unit; for the sake of clarity, the throttle 10 is not shown in FIG. 1, but see FIG. 3. Other embodiments of the heat pump 3, 4, 5, 10 are conceivable. The evaporator 4 and the condenser 2 are arranged in an open process air duct P of the dryer 1; the dryer 1 is accordingly a vented air dryer 1 with heat pump 3, 4, 5, 10.

In the section of the dryer depicted in FIG. 1 the flow directions of the process air in the dryer 1 are indicated, namely the inlet air direction Z and the outlet air direction A, with in this regard surrounding air being sucked in via a front wall 5 of the dryer 1 through a fan 6 via the condenser 2 and being directed within the process air duct P in the inlet air direction Z through the condenser 2. After subsequently flowing through the fan 6 and the drum 8 (not shown in FIG. 1, but see FIG. 3) the process air is directed in the outlet air direction A through the evaporator 4 and discharged at the rear 7 into the surroundings. The dryer 1 is thus embodied as a vented air dryer. As can be seen from the diagram depicted in FIG. 1 the condenser 2 and the evaporator 4, when viewed from the front, i.e. when viewed in the direction towards and through the front wall 5 of the condenser dryer 1, are on the one hand arranged behind one another and in addition, as regards their arrangement in relation to the throughflow direction, are almost positioned at right angles to each other. Since with a vented air dryer the condenser 2 and the evaporator 4, to recover heat from the outlet air of the dryer 1, must be arranged in separate areas and additionally connected to air ducts of the process air duct P, this arrangement is rather complex as regards its installation. In addition there are different embodiments for guidance of the process air, depending on whether a "pushing system," i.e. a process air ventilator 6 sits in the direction of flow before the drum 8 or the greatest pressure losses lie in the direction of flow after the ventilator wheel 6, or a "suction system" in which the conditions are inverted accordingly. FIG. 1 shows a pressure system in this regard.

As well as the right-angled arrangement of the condenser 2 and the evaporator 4 shown in FIG. 1, there can also be provision for the two components to be arranged offset behind one another and for non-right-angled arrangement in relation to each other to be provided.

Figure 2:
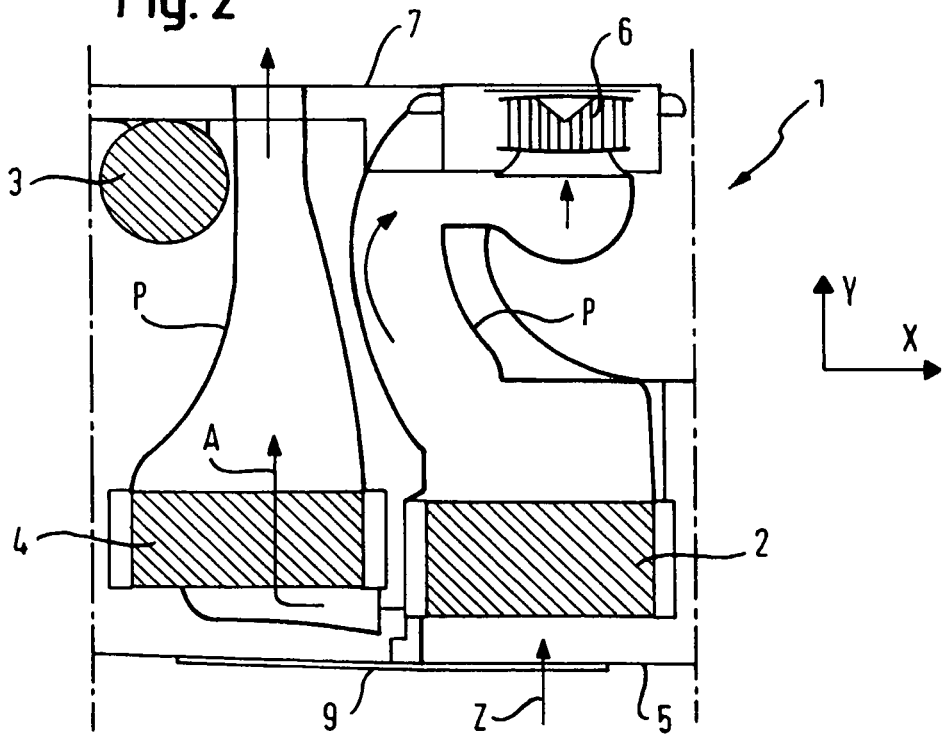
FIG. 2 a schematic overhead view of an exemplary embodiment of the dryer.

FIG. 2 shows an overhead view of a dryer 1 embodied as a vented-air dryer, with the diagram only showing the components of importance for explaining the embodiment. The dryer 1 comprises a heat pump circuit 2, 3, 4, 10 with a condenser 2, a compressor 3 and an evaporator 4, with the condenser 2 and the evaporator 4 being arranged in the process air duct P. A fan 6 sucks the process air via the condenser 2 and corresponding air ducts of the process air duct P, in accordance with the arrow shown, along inlet air direction Z into the drum 8 which functions as the drying chamber (see FIG. 3). After its exit from the drum 8, the process air laden with moisture is directed in the outlet air direction A indicated by the arrow through the evaporator 4, and after exit from the evaporator, via the rear wall 7 out of the dryer 1 into its surroundings.

Because of the guidance of the process air through the open process air duct P the dryer 1 is correctly referred to as a vented air dryer; it should be pointed out however that there can still be condensation of moisture in this dryer 1. At the evaporator 4 the process air flowing off the objects to be dried is cooled, which means that there is likely to be condensation of moisture at this point. Care should thus be taken to catch any condensate arising. If no other provision is made, such condensate can be collected in a conventional manner in a collection container for later disposal. The corresponding means are generally known; for the sake of clarity they are not shown here.

In the embodiment depicted in FIG. 2, the condenser 2 and the evaporator 4 are arranged in a direction of view towards the front wall 5 and thus alongside one another when viewed in the y direction. In addition the condenser 2 and the evaporator 4 are arranged with a space between them in the x-direction, with there especially also being provision for the positioning of the condenser 2 and the evaporator 4 to be embodied so that their longitudinal axes, which extend in the y-direction and correspond both to the inlet air direction Z and also to the outlet air direction A, are arranged in parallel to one another. The condenser 2 and the evaporator 4 thus lie in one plane which is perpendicular to the inlet air direction Z and outlet air direction A. The process air duct P is embodied so that the directions of flow of the process air through the evaporator 4 or the condenser 2 are parallel and in the same direction as each other. There can also be provision for the directions of flow through the evaporator 4 and the condenser 2 to be parallel and in opposite directions to one another.

In addition the condenser 2 and the evaporator 4 are arranged adjacent to each other in the dryer 1 and near to the front wall 5 in the inside. Arranged on the front wall 5 in the exemplary embodiment is a single flap 9, so that when this flap 9 is opened, both components, namely the condenser 2 and the evaporator 4, are accessible via the front side of the dryer 1. The flap 9 is only depicted symbolically in FIG. 2.

Figure 3:
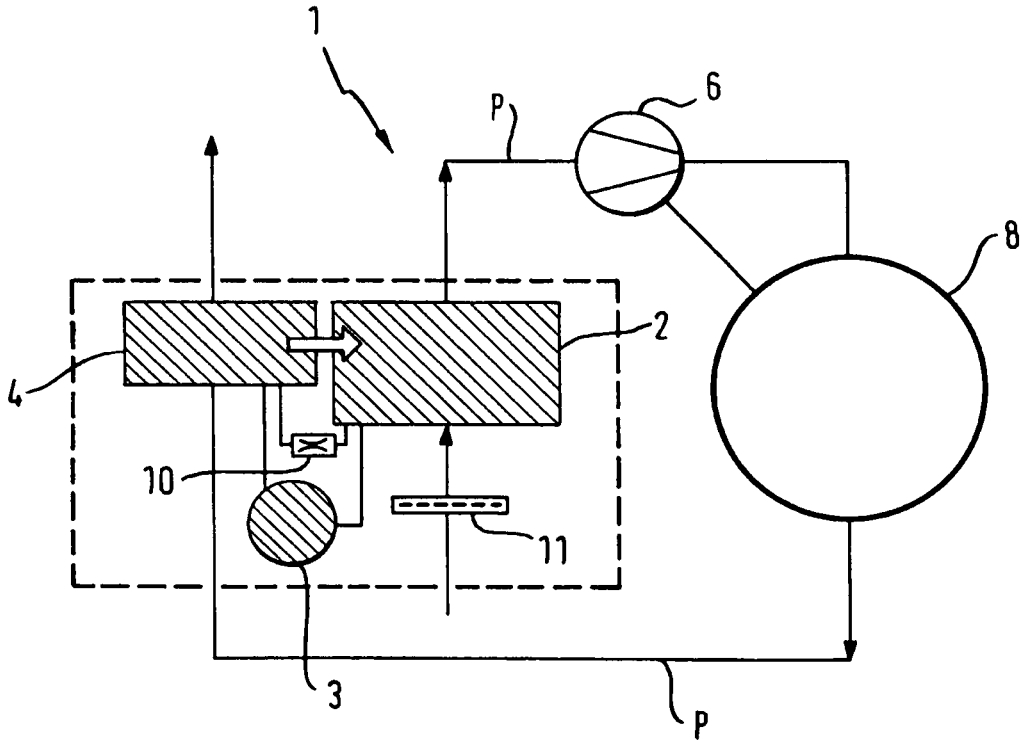
FIG. 3 a schematic block diagram of the dryer as depicted in FIG. 2.

In addition, in the direction of flow of the process air a filter 11 able to be inserted reversibly and without damaging it and removed again is arranged before the condenser 2 (not shown in FIG. 2, but see FIG. 3).

FIG. 3 shows a schematic block diagram of the dryer 1 in accordance with FIG. 2. The dryer 1 has the drum 8 rotatable via its horizontal axis, which is embodied as a drying chamber 8. The surrounding air sucked in by the fan 6 from the surroundings of the dryer 1 is initially directed through the filter 11 and then through the condenser 2. In the condenser 2 the coolant flowing in the cooling circuit is condensed while emitting heat into the process air. The coolant now present in liquid form is subsequently directed to a throttle 10 and via this once again to the evaporator 4. This closes the coolant circuit. The further course of the flow of process air after its exit from the condenser 2 has already been explained for FIG. 2. After its exit from the drum 8 the moist process air flows through the evaporator 4. It is cooled off there. After leaving the evaporator 4 the process air is discharged into the surroundings.

The drum 8 and also the fans 6 and 7 are driven via a common motor, which is not shown for the sake of clarity; the common drive is symbolized by a sloping line joining the fan 6 and the drum 8.

The invention claimed is:

1. A dryer, comprising:
a front wall;
a rear wall opposed to the front wall;
a drying chamber;
a process air duct, which is disposed between the front wall and the rear wall, for guiding process air through the drying chamber;
a heat pump with a heat sink in the process air duct and through which air can flow in an outlet air direction for cooling down the process air; and
a heat source arranged in the process air duct and through which air can flow in an inlet air direction for heating up the process air,
wherein the outlet air direction and the inlet air direction are substantially parallel to one another,
wherein the heat sink and the heat source are disposed in a horizontal plane substantially perpendicular to the outlet air direction and to the inlet air direction, and
wherein the heat sink and the heat source are disposed laterally alongside one another in the horizontal plane when viewed in a spatial direction from a front of the dryer, wherein the spatial direction extends from the front wall toward the rear wall.

2. The dryer of claim 1, wherein the heat sink and the heat source are disposed laterally alongside one another with a space between them in the horizontal plane when viewed in the spatial direction from the front of the dryer.

3. The dryer of claim 1, wherein the heat sink comprises an evaporator for a coolant circulating in the heat pump and the heat source comprises a condenser for the coolant.

4. The dryer of claim 1, further comprising a flap in a wall of the dryer, through which the heat sink or the heat source are accessible.

5. The dryer of claim 4, wherein the flap is on a front wall of the dryer.

6. The dryer of claim 1, further comprising a filter before the heat source in the direction of flow of the process air.

7. The dryer of claim 6, wherein the filter is removable.

8. The dryer of claim 1, further comprising:
a flap in a wall of the dryer,
wherein the heat sink and the heat source are accessible through the flap.

9. The dryer of claim 1, further comprising:
a flap in a front wall of the dryer,
wherein the heat sink and the heat source are disposed adjacent to the front wall of the dryer and are accessible through the flap via a front side of the dryer.

10. The dryer of claim 1, further comprising:
a removable filter disposed in the process air duct and before the heat source in the inlet air direction,
wherein the removable filter is disposed adjacent to a front wall of the dryer and accessible via a front side of the dryer.

11. The dryer of claim 10, wherein the filter is reversible.

12. A dryer comprising:
a drying chamber;
a process air duct that guides a process air through the drying chamber; and
a heat pump including a heat sink and a heat source disposed in the process air duct,
wherein the heat sink is disposed in a first portion of the process air duct through which air can flow in an outlet air direction for cooling down the process air, and
wherein the heat source is disposed in a second portion of the process air duct through which air can flow in an inlet air direction for heating up the process air,
wherein the outlet air direction is substantially parallel to and alongside the inlet air direction,
wherein the heat sink and the heat source are disposed in a plane substantially perpendicular to the outlet air direction and to the inlet air direction when viewed from an overhead view of the dryer, and
wherein the heat sink is disposed alongside the heat source when viewed in a spatial direction from a front of the dryer.

13. The dryer of claim 12, wherein the heat sink and the heat source are separated by a space when viewed in the spatial direction from the front of the dryer.

14. The dryer of claim 12, wherein the heat sink and the heat source do not overlap each other when viewed in the spatial direction from the front of the dryer.

15. The dryer of claim 12, wherein the heat sink has a first longitudinal axis that is parallel to a direction of a flow of the process air through the heat sink, wherein the heat source has a second longitudinal axis that is parallel to a direction of a flow of the process air through the heat source, wherein the first longitudinal axis is parallel to and alongside the second longitudinal axis when viewed in the spatial direction from the front of the dryer.

16. The dryer of claim 15, wherein the heat sink and the heat source do not overlap each other when viewed in the spatial direction from the front of the dryer.

17. The dryer of claim 12, wherein the heat sink comprises an evaporator for a coolant circulating in the heat pump, and wherein the heat source comprises a condenser for the coolant.

18. The dryer of claim 1, wherein the outlet air direction is a same parallel direction as the inlet air direction, wherein the same parallel direction extends in the direction from the front wall to the rear wall.

19. The dryer of claim 1, wherein the outlet air direction is an opposite parallel direction as the inlet air direction, wherein the outlet air direction extends in one of the direction extending from the front wall toward the rear wall and an opposite direction extending from the rear wall toward the front wall, and wherein the inlet air direction extends in the other of the direction extending from the front wall toward the rear wall and the opposite direction extending from the rear wall toward the front wall.

20. The dryer of claim 12, wherein the outlet air direction is a same parallel direction as the inlet air direction.

21. The dryer of claim 12, wherein the outlet air direction is an opposite parallel direction as the inlet air direction.

22. The dryer of claim 1, wherein the heat sink is disposed laterally alongside the heat source when viewed in a second spatial direction from an overhead view of the dryer.

23. The dryer of claim 12, wherein the heat sink is disposed alongside the heat source when viewed in a second spatial direction from the overhead view of the dryer.

24. The dryer of claim 1, wherein the dryer is a domestic laundry dryer.

25. The dryer of claim 12, wherein the dryer is a domestic laundry dryer.

26. The dryer of claim 12, further comprising a flap in a wall of the dryer, through which the heat sink and the heat source are accessible.

27. The dryer of claim 26, wherein the flap is on a front wall of the dryer.

28. The dryer of claim 26, further comprising a filter upstream of the heat source in the inlet air direction of the process air, wherein the filter is removable through the flap.

* * * * *